US012503663B2

(12) United States Patent
Arnst et al.

(10) Patent No.: US 12,503,663 B2
(45) Date of Patent: Dec. 23, 2025

(54) COLD FLOW ADDITIVES FOR PLASTIC-DERIVED SYNTHETIC FEEDSTOCK

(71) Applicant: Ecolab USA Inc., St. Paul, MN (US)

(72) Inventors: Theodore C. Arnst, Sugar Land, TX (US); Karina Eureste, Houston, TX (US); Tannon Shane Woodson, Houston, TX (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 18/647,790

(22) Filed: Apr. 26, 2024

(65) Prior Publication Data

US 2024/0287403 A1 Aug. 29, 2024

Related U.S. Application Data

(62) Division of application No. 17/471,784, filed on Sep. 10, 2021, now Pat. No. 11,999,920.

(Continued)

(51) Int. Cl.
*C10L 10/16* (2006.01)
*C10L 1/14* (2006.01)

(Continued)

(52) U.S. Cl.
CPC ..... *C10L 10/16* (2013.01); *C10L 1/146* (2013.01); *C10L 1/195* (2013.01); *C10L 1/1963* (2013.01); *C10L 2200/0461* (2013.01)

(58) Field of Classification Search
CPC ..... C10L 10/16; C10L 1/146; C10L 1/195; C10L 1/1963; C10L 2200/0461;

(Continued)

(56) References Cited

U.S. PATENT DOCUMENTS 3,093,623 A 6/1963 Stephan
3,819,589 A 6/1974 Fauke et al.

(Continued)

FOREIGN PATENT DOCUMENTS

AU 2005227358 A1 7/2006
AU 2013263852 A1 8/2014

(Continued)

OTHER PUBLICATIONS

Panda, Achyut Kumar, PhD Thesis, Jul. 2011, "Studies on process optimization for production of liquid fuels from waste plastics," Department of Chemical Engineering, National Institute of Technology, Rourkela, Odisha 769008, India. 216 pages, divided into five sections.

(Continued)

*Primary Examiner* — Cephia D Toomer
(74) *Attorney, Agent, or Firm* — Eric D. Babych; Barnes & Thornburg LLP

(57) ABSTRACT

Disclosed are pour point depressants used in compositions and methods for achieving the cold flow properties of synthetic feedstock derived from plastic. A method of obtaining the synthetic feedstock is also disclosed, which includes heating plastic under substantially oxygen free conditions at a temperature of from about 400° C. to about 850° C. to produce a pyrolysis effluent, condensing the heated a pyrolysis effluent to obtain a synthetic feedstock, recovering the synthetic feedstock, and adding a pour point depressant to the synthetic feedstock to lower the pour point.

12 Claims, 2 Drawing Sheets

Related U.S. Application Data

(60) Provisional application No. 63/078,111, filed on Sep. 14, 2020.

(51) Int. Cl.
*C10L 1/195* (2006.01)
*C10L 1/196* (2006.01)

(58) Field of Classification Search
CPC ..... C10L 2200/0438; C10L 2200/0446; C10L 2230/14; C10L 2290/02; C10L 2290/141; C10B 53/07; C10G 1/10; C10M 169/041; C10M 2203/1025; C10M 2205/028; C10M 2209/02; C10M 2209/062; C10N 2030/02
See application file for complete search history.

(56) References Cited

U.S. PATENT DOCUMENTS 3,901,951 A 8/1975 Nishizaki
3,947,368 A 3/1976 Sweeney
4,030,984 A 6/1977 Chambers
4,108,730 A 8/1978 Chen et al.
4,118,281 A 10/1978 Yan
4,121,026 A 10/1978 Cheng et al.
4,175,211 A 11/1979 Chen et al.
4,210,491 A 7/1980 Schulman
4,211,534 A 7/1980 Feldman
4,235,675 A 11/1980 Bechthold
4,235,676 A 11/1980 Chambers
4,252,542 A 2/1981 Spence
4,731,095 A 3/1988 Garapon et al.
4,732,092 A 3/1988 Gould
4,874,395 A 10/1989 Meyer
4,900,331 A 2/1990 Le
4,900,332 A 2/1990 Denis et al.
4,941,952 A 7/1990 Betz
4,948,495 A 8/1990 Coburn
4,970,969 A 11/1990 Koptis et al.
4,983,278 A 1/1991 Cha et al.
5,167,772 A 12/1992 Parker, Sr.
5,182,036 A 1/1993 Okorodudu et al.
5,214,224 A 5/1993 Comer et al.
5,316,734 A 5/1994 Yamaguchi
5,425,789 A 6/1995 Lewtas et al.
5,441,545 A 8/1995 Lewtas et al.
5,464,876 A 11/1995 Lyding et al.
5,468,780 A 11/1995 Kubota et al.
5,509,944 A 4/1996 Venkatadri et al.
5,707,943 A 1/1998 Covitch
5,711,767 A 1/1998 Gande et al.
5,720,232 A 2/1998 Meador
5,851,429 A 12/1998 Magyar
5,894,012 A 4/1999 Denison
6,036,124 A 3/2000 Takahashi et al.
6,143,043 A 11/2000 Botros
6,149,881 A 11/2000 Hanson et al.
6,150,577 A 11/2000 Miller et al.
6,187,083 B1 2/2001 Malhotra et al.
6,774,271 B2 8/2004 Jiang
6,774,272 B2 8/2004 Miller
6,822,126 B2 11/2004 Miller
6,830,597 B1 12/2004 Green
7,041,738 B2 5/2006 Krull et al.
7,413,583 B2 8/2008 Langer et al.
7,534,748 B2 5/2009 Patel et al.
7,820,604 B2 10/2010 Ruhe, Jr. et al.
7,820,605 B2 10/2010 Stokes et al.
8,048,333 B2 11/2011 Vitale et al.
8,088,961 B2 1/2012 Miller
8,158,842 B2 4/2012 McCall
8,304,592 B2 11/2012 Luebke
8,329,969 B2 12/2012 McCall et al.
8,394,264 B2 3/2013 Sappok et al.
8,425,627 B2 4/2013 Dietz et al.
8,466,332 B1 6/2013 Hemmings et al.
8,703,674 B2 4/2014 Umehara et al.
8,722,596 B2 5/2014 Umehara et al.
8,927,797 B2 1/2015 Sarker
8,992,636 B1 3/2015 Fang et al.
9,012,385 B2 4/2015 Di Biase et al.
9,175,141 B2 11/2015 Wray et al.
9,181,510 B2 11/2015 Barton et al.
9,200,207 B2 12/2015 Huang et al.
9,234,138 B1 1/2016 Li et al.
9,315,732 B1 4/2016 Fowler
9,534,183 B2 1/2017 Papin et al.
9,556,395 B2 1/2017 Kashani-Shirazi et al.
9,624,439 B2 4/2017 Bakaya et al.
10,131,847 B2 11/2018 McNamara et al.
10,150,928 B2 12/2018 Scherer et al.
10,160,927 B2 12/2018 Hellawell et al.
10,208,253 B2 2/2019 McNamara et al.
10,233,395 B2 3/2019 Ward et al.
2002/0040546 A1 4/2002 Botros
2003/0031722 A1 2/2003 Cao et al.
2003/0047437 A1 3/2003 Stankevitch
2003/0050519 A1 3/2003 Cheng
2003/0104943 A1 6/2003 Lennon et al.
2003/0166811 A1 9/2003 Peiffer et al.
2004/0152930 A1 8/2004 Dennis
2004/0192980 A1 9/2004 Appel et al.
2004/0204620 A1 10/2004 Grispin
2005/0050792 A1 3/2005 Corkwell et al.
2005/0086855 A1 4/2005 Tack et al.
2005/0131260 A1 6/2005 Tokarz
2006/0037852 A1 2/2006 Noto
2007/0051033 A1 3/2007 Martin et al.
2007/0161519 A1 7/2007 Cravey et al.
2007/0173419 A1 7/2007 Mead et al.
2008/0051520 A1 2/2008 Srinivasan et al.
2008/0103076 A1 5/2008 Ruhe et al.
2008/0178522 A1 7/2008 Siggelkow et al.
2008/0200738 A1 8/2008 Grispin
2008/0295397 A1 12/2008 Muth
2009/0170739 A1 7/2009 Miller
2010/0065411 A1 3/2010 Li et al.
2010/0180492 A1 7/2010 Krull et al.
2010/0320070 A1 12/2010 DeWhitt
2011/0042268 A1 2/2011 Stark et al.
2011/0083953 A1 4/2011 Horn et al.
2011/0306808 A1 12/2011 Appel et al.
2012/0215043 A1 8/2012 Gaffney
2012/0220675 A1 8/2012 DeWhitt
2012/0245063 A1 9/2012 DiBiase et al.
2012/0255222 A1 10/2012 DiBiase et al.
2012/0261247 A1 10/2012 McNamara et al.
2012/0264662 A1 10/2012 DiBiase et al.
2012/0264664 A1 10/2012 DiBiase et al.
2012/0277133 A1 11/2012 DiBiase et al.
2012/0283156 A1 11/2012 DiBiase et al.
2013/0015608 A1 1/2013 Hamby et al.
2013/0025189 A1 1/2013 Burgazli et al.
2013/0225462 A1 8/2013 Di Biase et al.
2013/0227878 A1 9/2013 Wolf et al.
2014/0054815 A1 2/2014 Houk et al.
2014/0190692 A1 7/2014 Hibbeler et al.
2014/0259923 A1 9/2014 Blair
2014/0262728 A1 9/2014 Karanikas
2014/0338253 A1 11/2014 Jung et al.
2015/0060258 A1 3/2015 Appel et al.
2015/0113859 A1 4/2015 Voelkel et al.
2015/0113867 A1 4/2015 Voelkel et al.
2015/0139889 A1 5/2015 Horn et al.
2015/0197692 A1 7/2015 Wang
2015/0203784 A1 7/2015 Barton et al.
2015/0232781 A1 8/2015 Barton
2015/0284495 A1 10/2015 Reed et al.
2016/0040073 A1 2/2016 Bakaya et al.
2016/0040089 A1 2/2016 Baker et al.
2016/0046880 A1 2/2016 Combs
2016/0115369 A1 4/2016 Soriano, Jr. et al.
2016/0169509 A1 6/2016 Fowler

(56) References Cited

U.S. PATENT DOCUMENTS

| | | | |
|---|---|---|---|
| 2016/0257879 | A1 | 9/2016 | Huang et al. |
| 2017/0015911 | A1 | 1/2017 | Houk et al. |
| 2017/0081591 | A1 | 3/2017 | Reed |
| 2017/0114279 | A1 | 4/2017 | Alyaser |
| 2017/0130153 | A1 | 5/2017 | Peretolchin et al. |
| 2017/0190949 | A1 | 7/2017 | Solomon et al. |
| 2017/0218278 | A1 | 8/2017 | Bakaya et al. |
| 2017/0321124 | A1 | 11/2017 | Hsu et al. |
| 2017/0349836 | A1 | 12/2017 | Duncan |
| 2018/0010048 | A1 | 1/2018 | Oluwaseun et al. |
| 2018/0010049 | A1 | 1/2018 | Tenore et al. |
| 2018/0010050 | A1 | 1/2018 | Van Der Ree et al. |
| 2018/0066200 | A1 | 3/2018 | Scherer |
| 2018/0086862 | A1 | 3/2018 | Kundu et al. |
| 2018/0244605 | A1 | 8/2018 | Khanlari et al. |
| 2018/0251692 | A1 | 9/2018 | Mezger et al. |
| 2019/0168192 | A1 | 6/2019 | Gaffney |
| 2019/0177652 | A1 | 6/2019 | Atkins et al. |
| 2019/0203135 | A1 | 7/2019 | Soriano, Jr. et al. |
| 2020/0017786 | A1 | 1/2020 | Li et al. |
| 2022/0081634 | A1 | 3/2022 | Arnst et al. |
| 2022/0396735 | A1 | 12/2022 | Wu et al. |

FOREIGN PATENT DOCUMENTS

| | | | | |
|---|---|---|---|---|
| BR | PI1004634 | A2 | | 3/2013 |
| BR | 102016027627 | A2 | | 6/2018 |
| CA | 2202941 | A1 | | 10/1998 |
| CN | 1338341 | A | | 3/2002 |
| CN | 1149598 | C | | 5/2004 |
| CN | 1239108 | C | | 2/2006 |
| CN | 101328414 | A | | 12/2008 |
| CN | 101386724 | A | | 3/2009 |
| CN | 101172238 | B | | 4/2010 |
| CN | 201458375 | U | | 5/2010 |
| CN | 101812348 | A | * | 8/2010 |
| CN | 101831313 | A | | 9/2010 |
| CN | 201581050 | U | | 9/2010 |
| CN | 201648314 | U | | 11/2010 |
| CN | 1962735 | B | | 12/2010 |
| CN | 101177502 | B | | 12/2010 |
| CN | 102504855 | A | | 6/2012 |
| CN | 202265543 | U | | 6/2012 |
| CN | 202415456 | U | | 9/2012 |
| CN | 101886020 | B | | 1/2013 |
| CN | 202705307 | U | | 1/2013 |
| CN | 202725185 | U | | 2/2013 |
| CN | 101210173 | B | | 4/2013 |
| CN | 101235279 | B | | 4/2013 |
| CN | 202953992 | U | | 5/2013 |
| CN | 202953993 | U | | 5/2013 |
| CN | 203043985 | U | | 7/2013 |
| CN | 203048877 | U | | 7/2013 |
| CN | 103242872 | A | | 8/2013 |
| CN | 103305253 | A | | 9/2013 |
| CN | 103382398 | A | | 11/2013 |
| CN | 203269856 | U | | 11/2013 |
| CN | 103450912 | A | | 12/2013 |
| CN | 203319926 | U | | 12/2013 |
| CN | 203333590 | U | | 12/2013 |
| CN | 203487095 | U | | 3/2014 |
| CN | 102942943 | B | | 4/2014 |
| CN | 104031665 | A | | 9/2014 |
| CN | 104073273 | A | | 10/2014 |
| CN | 104073279 | A | | 10/2014 |
| CN | 104130787 | A | | 11/2014 |
| CN | 104140827 | A | | 11/2014 |
| CN | 203960130 | U | | 11/2014 |
| CN | 204058363 | U | | 12/2014 |
| CN | 204211689 | U | | 3/2015 |
| CN | 204224524 | U | | 3/2015 |
| CN | 103571565 | B | | 4/2015 |
| CN | 204281679 | U | | 4/2015 |
| CN | 103172934 | B | | 6/2015 |
| CN | 204417413 | U | | 6/2015 |
| CN | 204434552 | U | | 7/2015 |
| CN | 103275746 | B | | 8/2015 |
| CN | 204644272 | U | | 9/2015 |
| CN | 104974779 | A | | 10/2015 |
| CN | 103980925 | B | | 12/2015 |
| CN | 204939396 | U | | 1/2016 |
| CN | 104531199 | B | | 3/2016 |
| CN | 205088187 | U | | 3/2016 |
| CN | 105462660 | A | | 4/2016 |
| CN | 205223110 | U | | 5/2016 |
| CN | 205347348 | U | | 6/2016 |
| CN | 105778955 | A | | 7/2016 |
| CN | 104560100 | B | | 8/2016 |
| CN | 205473591 | U | | 8/2016 |
| CN | 105925292 | A | | 9/2016 |
| CN | 106029847 | A | | 10/2016 |
| CN | 205635485 | U | | 10/2016 |
| CN | 205653411 | U | | 10/2016 |
| CN | 106085473 | A | | 11/2016 |
| CN | 106118706 | A | | 11/2016 |
| CN | 106185941 | A | | 12/2016 |
| CN | 106185943 | A | | 12/2016 |
| CN | 205774331 | U | | 12/2016 |
| CN | 106281384 | A | | 1/2017 |
| CN | 106433724 | A | | 2/2017 |
| CN | 106433726 | A | | 2/2017 |
| CN | 106433732 | A | | 2/2017 |
| CN | 106544050 | A | | 3/2017 |
| CN | 106544051 | A | | 3/2017 |
| CN | 106698421 | A | | 5/2017 |
| CN | 104650943 | B | | 6/2017 |
| CN | 206308313 | U | | 7/2017 |
| CN | 206318947 | U | | 7/2017 |
| CN | 206318948 | U | | 7/2017 |
| CN | 107033941 | A | | 8/2017 |
| CN | 107057745 | A | | 8/2017 |
| CN | 206392023 | U | | 8/2017 |
| CN | 206408173 | U | | 8/2017 |
| CN | 105713641 | | | 9/2017 |
| CN | 107151559 | A | | 9/2017 |
| CN | 107163967 | A | | 9/2017 |
| CN | 107216888 | A | | 9/2017 |
| CN | 105733644 | B | | 10/2017 |
| CN | 107236568 | A | | 10/2017 |
| CN | 107267181 | A | | 10/2017 |
| CN | 107267182 | A | | 10/2017 |
| CN | 206545002 | U | | 10/2017 |
| CN | 107384447 | A | | 11/2017 |
| CN | 107384465 | A | | 11/2017 |
| CN | 107418603 | A | | 12/2017 |
| CN | 107418605 | A | | 12/2017 |
| CN | 107420912 | A | | 12/2017 |
| CN | 107433280 | A | | 12/2017 |
| CN | 107433281 | A | | 12/2017 |
| CN | 107433282 | A | | 12/2017 |
| CN | 107434977 | A | | 12/2017 |
| CN | 107446608 | A | | 12/2017 |
| CN | 107446610 | A | | 12/2017 |
| CN | 107523362 | A | | 12/2017 |
| CN | 206692598 | U | | 12/2017 |
| CN | 206720749 | U | | 12/2017 |
| CN | 107537847 | A | | 1/2018 |
| CN | 107641522 | A | | 1/2018 |
| CN | 107674695 | A | | 2/2018 |
| CN | 106118708 | B | | 3/2018 |
| CN | 107828438 | A | | 3/2018 |
| CN | 105462615 | B | | 4/2018 |
| CN | 207362144 | U | | 5/2018 |
| CN | 108117881 | A | | 6/2018 |
| CN | 207446192 | U | | 6/2018 |
| CN | 207537397 | U | | 6/2018 |
| CN | 105038829 | B | | 7/2018 |
| CN | 105779017 | B | | 7/2018 |
| CN | 105950200 | B | | 7/2018 |
| CN | 106635116 | B | | 7/2018 |
| CN | 108285800 | A | | 7/2018 |
| CN | 108299673 | A | | 7/2018 |
| CN | 105754628 | B | | 8/2018 |
| CN | 108384565 | A | | 8/2018 |

(56) References Cited

FOREIGN PATENT DOCUMENTS

| | | | |
|---|---|---|---|
| CN | 108395572 | A | 8/2018 |
| CN | 108410007 | A | 8/2018 |
| CN | 108441241 | A | 8/2018 |
| CN | 108467513 | A | 8/2018 |
| CN | 106635114 | B | 9/2018 |
| CN | 106753502 | B | 9/2018 |
| CN | 108517222 | A | 9/2018 |
| CN | 207845569 | U | 9/2018 |
| CN | 207845574 | U | 9/2018 |
| CN | 207952195 | U | 10/2018 |
| CN | 106513419 | B | 11/2018 |
| CN | 108841405 | A | 11/2018 |
| CN | 106338066 | B | 12/2018 |
| CN | 106338067 | B | 12/2018 |
| CN | 109181738 | A | 1/2019 |
| CN | 109266375 | A | 1/2019 |
| CN | 106185938 | B | 2/2019 |
| CN | 106734060 | B | 4/2019 |
| CN | 106318546 | B | 5/2019 |
| CN | 106433725 | B | 5/2019 |
| CN | 109749757 | A | 5/2019 |
| CN | 109776274 | A | 5/2019 |
| CN | 108085044 | B | 10/2019 |
| CN | 108441242 | B | 4/2020 |
| CN | 112063403 | A | 12/2020 |
| CN | 106433703 | B | 1/2022 |
| CN | 107057738 | B | 8/2023 |
| DE | 131092 | A1 | 5/1978 |
| DE | 2748510 | A1 | 5/1978 |
| DE | 2725650 | C3 | 1/1980 |
| DE | 3205603 | A1 | 11/1982 |
| DE | 3030593 | C2 | 1/1987 |
| DE | 3323161 | C2 | 2/1987 |
| DE | 2917293 | C2 | 5/1987 |
| DE | 4103738 | A1 | 10/1991 |
| DE | 3786997 | T2 | 11/1993 |
| DE | 4210237 | C2 | 2/1994 |
| DE | 4234385 | A1 | 4/1994 |
| DE | 4403128 | A1 | 8/1995 |
| DE | 4417721 | A1 | 11/1995 |
| DE | 4423394 | C1 | 3/1996 |
| DE | 4435238 | A1 | 4/1996 |
| DE | 4437881 | A1 | 4/1996 |
| DE | 4329458 | C2 | 5/1996 |
| DE | 19505544 | C1 | 5/1996 |
| DE | 19617450 | A1 | 11/1997 |
| DE | 19800567 | A1 | 7/1999 |
| DE | 19834596 | C1 | 2/2000 |
| DE | 4446964 | C2 | 7/2002 |
| DE | 202006003429 | U1 | 7/2007 |
| DE | 202006003430 | U1 | 7/2007 |
| DE | 102006014457 | A1 | 10/2007 |
| DE | 102008019237 | A1 | 11/2008 |
| DE | 102007054343 | A1 | 5/2009 |
| DE | 102007051373 | B4 | 11/2010 |
| DE | 102012204648 | A1 | 9/2013 |
| DE | 102012109874 | A1 | 4/2014 |
| DE | 102014014816 | A1 | 4/2016 |
| DE | 102012008457 | B4 | 11/2016 |
| EP | 0072387 | B1 | 1/1987 |
| EP | 0226895 | B1 | 8/1989 |
| EP | 0297420 | B1 | 2/1991 |
| EP | 0316827 | B1 | 5/1991 |
| EP | 0191967 | B1 | 3/1992 |
| EP | 0410889 | B1 | 10/1993 |
| EP | 0659867 | A2 | 6/1995 |
| EP | 0391735 | B1 | 8/1995 |
| EP | 0890629 | A1 | 1/1999 |
| EP | 0713906 | B1 | 5/1999 |
| EP | 0949321 | A2 | 10/1999 |
| EP | 0693527 | B1 | 6/2001 |
| EP | 1302526 | A1 | 4/2003 |
| EP | 1577366 | A2 | 9/2005 |
| EP | 1380635 | B1 | 1/2013 |
| EP | 1905811 | B1 | 8/2014 |
| EP | 2942382 | A1 | 11/2015 |
| EP | 1577367 | B1 | 3/2016 |
| EP | 2783764 | B1 | 7/2016 |
| EP | 3085757 | A1 | 10/2016 |
| EP | 1686141 | B1 | 12/2018 |
| EP | 3260181 | B1 | 9/2019 |
| EP | 3421576 | B1 | 3/2020 |
| FR | 2178061 | B1 | 5/1976 |
| GB | 1525114 | A | 9/1978 |
| GB | 2303859 | A | 3/1997 |
| GB | 2434372 | A | 7/2007 |
| GB | 2503065 | B | 11/2014 |
| GB | 2515560 | B | 12/2016 |
| GB | 2539518 | B | 9/2017 |
| GB | 2570019 | B | 4/2021 |
| JP | S511268 | Y2 | 1/1976 |
| JP | S5123988 | Y2 | 6/1976 |
| JP | S5126473 | Y2 | 7/1976 |
| JP | S5187584 | U | 7/1976 |
| JP | S5222390 | Y2 | 5/1977 |
| JP | S52144074 | U | 11/1977 |
| JP | S5345302 | Y2 | 10/1978 |
| JP | S5424981 | Y2 | 8/1979 |
| JP | S5621578 | B2 | 5/1981 |
| JP | S5798591 | U | 6/1982 |
| JP | S5971395 | A | 4/1984 |
| JP | S6090293 | A | 5/1985 |
| JP | S61123837 | A | 6/1986 |
| JP | S62236893 | A | 10/1987 |
| JP | S63260981 | A | 10/1988 |
| JP | H01115918 | A | 5/1989 |
| JP | H0397788 | A | 4/1991 |
| JP | H03243692 | A | 10/1991 |
| JP | H05100427 | A | 4/1993 |
| JP | H05171159 | A | 7/1993 |
| JP | H05320658 | A | 12/1993 |
| JP | H06134434 | A | 5/1994 |
| JP | H06158062 | A | 6/1994 |
| JP | H06166880 | A | 6/1994 |
| JP | H0948982 | A | 2/1997 |
| JP | H0948983 | A | 2/1997 |
| JP | H0995676 | A | 4/1997 |
| JP | H09169982 | A | 6/1997 |
| JP | H09310075 | A | 12/1997 |
| JP | H1059704 | A | 3/1998 |
| JP | H10110174 | A | 4/1998 |
| JP | H10121056 | A | 5/1998 |
| JP | H10279950 | A | 10/1998 |
| JP | H10298569 | A | 11/1998 |
| JP | H10330761 | A | 12/1998 |
| JP | H10338886 | A | 12/1998 |
| JP | H11166184 | A | 6/1999 |
| JP | H11286686 | A | 10/1999 |
| JP | H11286687 | A | 10/1999 |
| JP | 2000086224 | A | 3/2000 |
| JP | 2000191766 | A | 7/2000 |
| JP | 2000265172 | A | 9/2000 |
| JP | 2000290661 | A | 10/2000 |
| JP | 2000309781 | A | 11/2000 |
| JP | 2000355690 | A | 12/2000 |
| JP | 2001049263 | A | 2/2001 |
| JP | 2001115163 | A | 4/2001 |
| JP | 2001187406 | A | 7/2001 |
| JP | 2001200268 | A | 7/2001 |
| JP | 2001232634 | A | 8/2001 |
| JP | 2001232637 | A | 8/2001 |
| JP | 2001240406 | A | 9/2001 |
| JP | 2002020535 | A | 1/2002 |
| JP | 2002047493 | A | 2/2002 |
| JP | 2002053869 | A | 2/2002 |
| JP | 2002138286 | A | 5/2002 |
| JP | 2002285165 | A | 10/2002 |
| JP | 2002327182 | A | 11/2002 |
| JP | 2002332380 | A | 11/2002 |
| JP | 2003039056 | A | 2/2003 |
| JP | 2003041265 | A | 2/2003 |
| JP | 3383296 | B1 | 3/2003 |
| JP | 2003130319 | A | 5/2003 |
| JP | 2003176483 | A | 6/2003 |

(56) References Cited

FOREIGN PATENT DOCUMENTS

| | | | |
|---|---|---|---|
| JP | 2003205281 | A | 7/2003 |
| JP | 2003213034 | A | 7/2003 |
| JP | 2003236517 | A | 8/2003 |
| JP | 2003268098 | A | 9/2003 |
| JP | 2004002054 | A | 1/2004 |
| JP | 2004035807 | A | 2/2004 |
| JP | 2004099693 | A | 4/2004 |
| JP | 2004131358 | A | 4/2004 |
| JP | 2004161971 | A | 6/2004 |
| JP | 2004285134 | A | 10/2004 |
| JP | 2004285255 | A | 10/2004 |
| JP | 2004307779 | A | 11/2004 |
| JP | 2004307780 | A | 11/2004 |
| JP | 2005015701 | A | 1/2005 |
| JP | 2005097737 | A | 4/2005 |
| JP | 2005153434 | A | 6/2005 |
| JP | 2005154510 | A | 6/2005 |
| JP | 2005154516 | A | 6/2005 |
| JP | 2005194537 | A | 7/2005 |
| JP | 2005314552 | A | 11/2005 |
| JP | 2005314748 | A | 11/2005 |
| JP | 2006028593 | A | 2/2006 |
| JP | 2006036688 | A | 2/2006 |
| JP | 2006089742 | A | 4/2006 |
| JP | 2006096979 | A | 4/2006 |
| JP | 2006206810 | A | 8/2006 |
| JP | 2006220328 | A | 8/2006 |
| JP | 2006234291 | A | 9/2006 |
| JP | 2007139363 | A | 6/2007 |
| JP | 2008080634 | A | 4/2008 |
| JP | 2008150477 | A | 7/2008 |
| JP | 2010242071 | A | 10/2010 |
| JP | 2011006528 | A | 1/2011 |
| JP | 2011033333 | A | 2/2011 |
| JP | 2011111511 | A | 6/2011 |
| JP | 2011219622 | A | 11/2011 |
| JP | 2011219627 | A | 11/2011 |
| JP | 2011236098 | A | 11/2011 |
| JP | 2011236099 | A | 11/2011 |
| JP | 2011236377 | A | 11/2011 |
| JP | 2012087222 | A | 5/2012 |
| JP | 2012136672 | A | 7/2012 |
| JP | 2013231109 | A | 11/2013 |
| JP | 2014156544 | A | 8/2014 |
| JP | 2018135443 | A | 8/2018 |
| JP | 2019135278 | A | 8/2019 |
| JP | 2019135281 | A | 8/2019 |
| KR | 20100103953 | A | 9/2010 |
| KR | 101156195 | B1 | 6/2012 |
| KR | 101347906 | B1 | 1/2014 |
| KR | 20140114614 | A | 9/2014 |
| KR | 101815917 | B1 | 1/2018 |
| KR | 101817728 | B1 | 1/2018 |
| MX | 2011013990 | A | 6/2012 |
| MX | 2015004252 | A | 9/2016 |
| PL | 401930 | A1 | 6/2014 |
| PL | 406360 | A1 | 6/2015 |
| RU | 16711 | U1 | 2/2001 |
| RU | 2011151416 | A | 6/2013 |
| SK | 28297 | A3 | 4/1998 |
| TW | 261547 | B | 11/1995 |
| TW | M484061 | U | 8/2014 |
| WO | 1981001713 | A1 | 6/1981 |
| WO | 1987000082 | A1 | 1/1987 |
| WO | 1989004355 | A1 | 5/1989 |
| WO | 1991011499 | A1 | 8/1991 |
| WO | 1991018960 | A1 | 12/1991 |
| WO | 1992001767 | A2 | 2/1992 |
| WO | 1992004423 | A2 | 3/1992 |
| WO | 1992009671 | A1 | 6/1992 |
| WO | 1992022528 | A2 | 12/1992 |
| WO | 1994010107 | A1 | 5/1994 |
| WO | 1994010507 | A1 | 5/1994 |
| WO | 1994013763 | A1 | 6/1994 |
| WO | 1995003375 | A1 | 2/1995 |
| WO | 1995032262 | A1 | 11/1995 |
| WO | 1996000268 | A1 | 1/1996 |
| WO | 1996012755 | A1 | 5/1996 |
| WO | 1996023104 | A1 | 8/1996 |
| WO | 1997001616 | A1 | 1/1997 |
| WO | 1997006224 | A1 | 2/1997 |
| WO | 1998044074 | A1 | 10/1998 |
| WO | 1998045239 | A1 | 10/1998 |
| WO | 2000006668 | A1 | 2/2000 |
| WO | 2000047658 | A1 | 8/2000 |
| WO | 2000053385 | A1 | 9/2000 |
| WO | 2000053699 | A1 | 9/2000 |
| WO | 2000064998 | A1 | 11/2000 |
| WO | 2001003473 | A1 | 1/2001 |
| WO | 2001048032 | A1 | 7/2001 |
| WO | 2001060948 | A1 | 8/2001 |
| WO | 2001062823 | A1 | 8/2001 |
| WO | 2002022498 | A1 | 3/2002 |
| WO | 2002031082 | A1 | 4/2002 |
| WO | 2002072731 | A1 | 9/2002 |
| WO | 2003029384 | A1 | 4/2003 |
| WO | 2003042337 | A2 | 5/2003 |
| WO | 2003047778 | A1 | 6/2003 |
| WO | 2004011165 | A1 | 2/2004 |
| WO | 2004018592 | A1 | 3/2004 |
| WO | 2004072208 | A1 | 8/2004 |
| WO | 2004076595 | A1 | 9/2004 |
| WO | 2005040316 | A2 | 5/2005 |
| WO | 2005087897 | A1 | 9/2005 |
| WO | 2005097448 | A1 | 10/2005 |
| WO | 2005097953 | A1 | 10/2005 |
| WO | 2005108525 | A1 | 11/2005 |
| WO | 2005111093 | A1 | 11/2005 |
| WO | 2005121278 | A1 | 12/2005 |
| WO | 2006043924 | A1 | 4/2006 |
| WO | 2006096085 | A1 | 9/2006 |
| WO | 2006096086 | A1 | 9/2006 |
| WO | 2006124793 | A2 | 11/2006 |
| WO | 2007009022 | A2 | 1/2007 |
| WO | 2007014489 | A1 | 2/2007 |
| WO | 2007050746 | A1 | 5/2007 |
| WO | 2007091146 | A1 | 8/2007 |
| WO | 2007115443 | A1 | 10/2007 |
| WO | 2007143673 | A1 | 12/2007 |
| WO | 2008030137 | A1 | 3/2008 |
| WO | 2008075105 | A1 | 6/2008 |
| WO | 2008079054 | A2 | 7/2008 |
| WO | 2008126040 | A2 | 10/2008 |
| WO | 2009064685 | A2 | 5/2009 |
| WO | 2009087080 | A2 | 7/2009 |
| WO | 2009099341 | A2 | 8/2009 |
| WO | 2010049824 | A2 | 5/2010 |
| WO | 2010053381 | A1 | 5/2010 |
| WO | 2010106538 | A1 | 9/2010 |
| WO | 2010106539 | A2 | 9/2010 |
| WO | 2010116211 | A1 | 10/2010 |
| WO | 2010130404 | A1 | 11/2010 |
| WO | 2011008074 | A1 | 1/2011 |
| WO | 2011008075 | A1 | 1/2011 |
| WO | 2011009419 | A1 | 1/2011 |
| WO | 2011025593 | A1 | 3/2011 |
| WO | 2011028515 | A2 | 3/2011 |
| WO | 2011034446 | A1 | 3/2011 |
| WO | 2011079894 | A2 | 7/2011 |
| WO | 2011127701 | A1 | 10/2011 |
| WO | 2011131793 | A2 | 10/2011 |
| WO | 2012006523 | A1 | 1/2012 |
| WO | 2012014478 | A1 | 2/2012 |
| WO | 2012014480 | A1 | 2/2012 |
| WO | 2012018403 | A1 | 2/2012 |
| WO | 2012110991 | A1 | 8/2012 |
| WO | 2012127085 | A1 | 9/2012 |
| WO | 2012129482 | A2 | 9/2012 |
| WO | 2012131485 | A1 | 10/2012 |
| WO | 2012162837 | A1 | 12/2012 |
| WO | 2012172527 | A2 | 12/2012 |
| WO | 2013032027 | A1 | 3/2013 |
| WO | 2013036151 | A2 | 3/2013 |
| WO | 2013070801 | A1 | 5/2013 |

(56) References Cited

FOREIGN PATENT DOCUMENTS

| | | | |
|---|---|---|---|
| WO | 2013087701 | A1 | 6/2013 |
| WO | 2013089587 | A1 | 6/2013 |
| WO | 2013106546 | A1 | 7/2013 |
| WO | 2013119941 | A1 | 8/2013 |
| WO | 2013123377 | A1 | 8/2013 |
| WO | 2013171510 | A1 | 11/2013 |
| WO | 2013187788 | A2 | 12/2013 |
| WO | 2014032843 | A1 | 3/2014 |
| WO | 2014041212 | A1 | 3/2014 |
| WO | 2014043051 | A1 | 3/2014 |
| WO | 2014051514 | A1 | 4/2014 |
| WO | 2014057430 | A1 | 4/2014 |
| WO | 2014070908 | A1 | 5/2014 |
| WO | 2014135754 | A1 | 9/2014 |
| WO | 2014167139 | A2 | 10/2014 |
| WO | 2014177727 | A1 | 11/2014 |
| WO | 2014184290 | A1 | 11/2014 |
| WO | 2014200330 | A1 | 12/2014 |
| WO | 2015019313 | A2 | 2/2015 |
| WO | 2015082755 | A2 | 6/2015 |
| WO | 2015162505 | A2 | 10/2015 |
| WO | 2015194978 | A1 | 12/2015 |
| WO | 2016030460 | A1 | 3/2016 |
| WO | 2016034739 | A1 | 3/2016 |
| WO | 2016187144 | A1 | 11/2016 |
| WO | 2016209194 | A1 | 12/2016 |
| WO | 2017009208 | A1 | 1/2017 |
| WO | 2017060464 | A1 | 4/2017 |
| WO | 2017088015 | A1 | 6/2017 |
| WO | 2017113020 | A1 | 7/2017 |
| WO | 2017115261 | A1 | 7/2017 |
| WO | 2017152205 | A1 | 9/2017 |
| WO | 2017168164 | A1 | 10/2017 |
| WO | 2017172351 | A2 | 10/2017 |
| WO | 2017173006 | A2 | 10/2017 |
| WO | 2017198896 | A1 | 11/2017 |
| WO | 2017205275 | A1 | 11/2017 |
| WO | 2018000050 | A1 | 1/2018 |
| WO | 2018084330 | A1 | 5/2018 |
| WO | 2018085934 | A1 | 5/2018 |
| WO | 2018104443 | A1 | 6/2018 |
| WO | 2019236779 | A1 | 12/2019 |
| WO | 2020178597 | A1 | 9/2020 |
| WO | 2020178599 | A1 | 9/2020 |
| WO | 2020212315 | A1 | 10/2020 |
| WO | 2022192577 | A1 | 9/2022 |
| WO | 2022212502 | A1 | 10/2022 |

OTHER PUBLICATIONS

Pasquali, Ricardo C. et al. "Some considerations about the hydrophilic-lipophilic balance system," International Journal of Pharmaceutics (2008) 356, pp. 44-51.

PCT International Search Report and Written Opinion for PCT/US2022/046428, mailed Jan. 26, 2023, 17 pages.

PCT Notification of Transmittal of the International Search Report and the Written Opinion of the International Searching Authority, or the Declaration, PCT/US2018/067597, Mar. 20, 2019, 15 pages.

PCT Notification of Transmittal of the International Search Report and the Written Opinion of the International Searching Authority, or the Declaration, PCT/US2019/040944, Sep. 25, 2019, 10 pages.

PCT Notification of Transmittal of the International Search Report and the Written Opinion of the International Searching Authority, or the Declaration, PCT/US2021/049790, Dec. 3, 2021, 15 pages.

Pradipta, Ilham Zulfa et al. "High Grade Liquid Fuel from Plastic Waste Pyrolysis Oil by Column Distillation," 2019 IEEE Conference on Energy Conversion, Oct. 16-17, 2019 Yogyakarta, Indonesia, pp. 240-244.

Raheem, A.B. et al. "The conversion of post-consumer polyethylene terephthalate (PET) into a thermosetting polyester resin," Archives of Applied Science Research (2010) 2(4), pp. 240-254.

Sakata, Yusaku et al. "Development of a catalystic dehaologenation (Cl, Br) process for municipal waster plastic-derived oil," Journal of Material Cycles and Waste Management (2003) 5, pp. 113-124.

Sanchez-Rodriguez, Daniel et al. "Inhibition effect of amine compounds derived from hardening agents on the extraction of hydrogen bromide by water from the pyrolysis oil of brominated printed circuit boards," Journal of Cleaner Production (2020) 265, pp. 1-10.

Sarker, Moinuddin et al. "A new technology proposed to recycle waste plastics into hydrocarbon fuel in USA," International Journal of Energy and Environment (2012) 3(5), pp. 749-760.

Schleiffer, Andreas "Synthetic Crude Oil from Petroleum Waste Materials," Preprints of Papers—American Chemical Society, Division of Fuel Chemistry (1994) 39(4), pp. 1060-1064.

Serrano, D.P. et al. "Conversion of low density polyethylene into petrochemical feedstocks using a continuous screw kiln reactor," Journal of Analytical and Applied Pyrolysis (2001) 58-59, pp. 789-801.

Siddiqui, Mohammad Nahid et al. "Useful Liquid Products from the Pyrolysis of Mixed Plastics," Preprints of Papers—American Chemical Society, Division of Fuel Chemistry (2007) 52(2), pp. 761-762.

Singh, Thokchom Subhaschandra et al. "A lab scale waste to energy conversion study for pyrolysis of plastic with and without catalyst: Engine emissions testing study," Fuel (2020) 277, pp. 1-10.

Sojak, L. et al. "GC-MS of Polyethylene and Polypropylene Thermal Cracking Products," Petroleum & Coal (2006) 48 (1), pp. 1-14.

Soldi, Rafael A. et al. "Polymethacrylates: Pour point depressants in diesel oil," European Polymer Journal. 2007, 43, pp. 3671-3678.

Song, Yuping et al. "Study on the relationship between the structure and activities of alkyl methacrylate-maleic anhydride polymers as cold flow improvers in diesel fuels," Fuel Processing Technology. 2005, 86, pp. 641-650.

Soni, Hemant P. et al. "Performance-Based Designing of Wax Crystal Growth Inhibitors." Energy & Fuels. 2008, 22(6), pp. 3930-3939.

Sonwane, H.W. et al. "Desulfurization of Pyrolysis Oil Obtained from Plastic Waste by Using Adsorption Method," International Research Journal of Engineering and Technology (IRJET) (2017) 4(7), pp. 1248-1251.

Srivastava, S.P, et al. "Flow Improvers and Paraffin Dispersants of Fuels," Fuels and fuel-additives (2014) pp. 243-253.

Tasheva, Yordanka et al. "Possibilities for Purification of Pyrolysis Oil to Obtain Ecological Products," Annual of Assen Zlatarov University, Burgas, Bulgaria (2011) 40, pp. 62-65.

Thahir, Ramli et al. "Production of liquid fuel from plastic waster using integrated pyrolysis method with refinery distillation bubble cap plate column," Energy Reports (2019) 5, pp. 70-77.

Turemuratov et al. (2015) "Synthesis and Properties of Depressators Based on Sopolymers in the Presence of Gossypol Pitch", Oriental Journal of Chemistry, 31(3):1447-1453.

Vasile, Cornelia et al. "Feedstock recycling from plastic and thermoset fractions of used computers (I): pyrolysis," Journal of Material Cycles and Waste Management (2006) 8, pp. 99-108.

Vouvoudi, Evangelia C. et al. "Pyrolytic degradation of common polymers present in packaging materials," Journal of Thermal Analysis and Calorimetry (2019) 138, pp. 2683-2689.

Williams, P.T. et al. "Recycling plastic waste by pyrolysis," Journal of the Institute of Energy (1998) 71, pp. 81-93.

Williams, Paul T. "Yield and Composition of Gases and Oils/Waxes from the Feedstock Recycling of Waste Plastic," Feedstock Recycling and Pyrolysis of Waste Plastics: Converting Waste Plastics into Diesel and Other Fuels. Edited by John Scheirs. Chichester, UK: John Wiley & Sons Ltd., (2006) pp. 285-313.

Wiriyaumpaiwong, Songchai et al. "Distillation of Pyrolytic Oil Obtained from Fast Pyrolysis of Plastic Wastes," Energy Procedia (2017) 138, pp. 111-115.

Xu, Jun et al. Synthesis of Poly(maleic acid alkylamide-co-r-olefin-co-styrene) Co-polymers and Their Effect on the Yield Stress and Morphology of Waxy Gels with Asphaltenes, Energy & Fuels. 2011, 25, pp. 573-579.

Xu, Shannan et al. "Synergistic effects of catalytic co-pyrolysis of macroalgae with waste plastics," Process Safety and Environmental Protections (2020) 137, pp. 34-48.

(56) References Cited

OTHER PUBLICATIONS

Xue et al. (2016) "The influence of polymethyl acrylate as a pour point depressant for biodiesel", Energy Sources, Part A: Recovery, Utilization, and Environmental Effects, 39(1):17-22.
Yang, Bing et al. "Research and Application Development of Highly Loaded Degradable Plastic Products," Suliao (2014) 43(4), pp. 39-42, with English abstract.
Zabarnick, Steven et al. "Studies of Urea Treatment on the Low-Temperature Properties of Jet Fuel," Energy & Fuels. 2002, 16(6), pp. 1565-1570.
Zahedi, Ali Reza et al. "Unsaturated polyester resin via chemical recyclying of off-grade poly(ethylene terephthalate)," Polymer International (2009) 58, pp. 1084-1091.
Zassa, M. Della et al. "Two-steps selective thermal depolymerization of polyethylene. 1: Feasibility and effect of devolatilization heating policy," Journal of Analytical and Applied Pyrolysis (2010) 87, pp. 248-255.
Zhang, Huiyan et al. "Catalytic pyrolysis of black-liquor lignin by co-feeding with different plastics in a fluidized bed reactor," Bioresource Technology (2015) 192, pp. 68-74.
International Preliminary Report on Patentability for PCT/US2023/0141430, mailed Sep. 19, 2024, 13 pages.
Paramasivam Baranitharan et al.: "Investigation and improvement on storage stability of pyrolysis oil obtained from Aegle marmelos de-oiled seed cake", Energy Sources, Part A: Recovery, Utilization, and Environmental Effects, vol. 43, No. 8, Jun. 24, 2019, pp. 953-967.
Sakthivel R. et al: "Experimental investigation on improvement of storage stability of bio-oil derived from intermediate pyrolysis of Calophyllum inophyllum seed cake", Journal of the Energy Institute, vol. 92, No. 3, Mar. 1, 2018, pp. 768-782.
Sharma Abhishek et al: "Effect of blending waste tyre derived fuel on oxidation stability of biodiesel and performance and emission studies of a diesel engine", Applied Thermal Engineering, Pergamon, Oxford, GB, vol. 118, Mar. 3, 2017, pp. 365-374.
Aguado, J. et al. "Feedstock recycling of polyethylene in a two-step thermo-catalytic reaction system," Journal of Analytical Applied Pyrolysis (2007) 79, pp. 415-423.
Ali, Mohammad Farhat et al. "Chapter 14. The Conversion of Waste Plastics/Petroleum Residue Mixtures to Transportation Fuels," Feedstock Recycling and Pyrolysis of Waste Plastics. Edited by John Scheirs et al. Chichester, UK: John Wiley & Sons Ltd, 2006, pp. 363-380.
Ali, Mohammad Farhat et al. "The Conversion of Waste Plastics/Petroleum Residue Mixtures to Transportation Fuels," Feedstock Recycling and Pyrolysis of Waste Plastics. Edited by John Scheirs. Chichester, UK: John Wiley & Sons Ltd., (2006) pp. 363-380.
Al-Salem, S.M. et al. "The valorization of plastic solid waste (PSW) by primary to quaternary routes: From re-use to energy and chemicals," Progress in Energy and Combustion Science (2010) 36, pp. 103-129.
Al-Shafey, H.I. et al. "Studies on the Influence of Long Chain Acrylic Esters Co-Polymers Grafted With Vinyl Acetate as Flow Improver Additives of Crude Oils," Advances in Applied Science Research. 2011, 2(5), pp. 476-489.
Angyal, Andras et al. "Petrochemical feedstock by thermal cracking of plastic waste," Journal of Analytical Applied Pyrolysis (2007) 79, pp. 409-414.
Arabiourrutia, Miriam et al. "Pyrolysis of Polyolefins in a Conical Spouted Bed Reactor: A Way to Obtain Valuable Products," Pyrolysis, Chapter 12. Rijeka, Croatia: InTech (2017) pp. 285-304.
Ashiri, Masafumi "Use of Supercritical Water as Reaction Solvent," Kagaku Sochi (1999) 41(2), pp. 31-36, with English abstract.
Aurich, H.-P. Marl "Pyrolyse, Hydrierung, Gaserzeugung," (Pyrolysis, Hydrogenation, Gasification), Kautschuk Gummi Kunststoffe (1994) 47(8), pp. 596-601, with English abstract.
Bhagat, Vishal et al. "Extraction of Fuel from Plastic Waste," International Journal of Pollution and Noise Control. 2020, 6(1), pp. 7-9.
Bhaskar, Thallada et al. "Thermal degradation of ABS-Br mixed with PP and catalytic debromination by iron oxide carbon composite catalyst (Fe—C)," Green Chemistry (2002) 4(6), pp. 603-606.
Borthakur, A et al. "Alkyl Fumarate-Vinyl Acetate Copolymer as Flow Improver for High Waxy Indian Crude Oils," Energy & Fuels. 1996, 10(3), pp. 844-848.
Buekens, Alfons et al. "Technical Methods in Plastics Pyrolysis," Macromolecular Symposia. 1998, 135, pp. 63-81.
Datta, Janusz et al. "Thermo-Chemical Decomposition Study of Polyurethane Elastomer Through Glycerolysis Route with Using Crude and Refined Glycerine as a Transesterification Agent," Journal of Polymers and the Environment (2018) 26(1), pp. 166-174.
De la Puente, Gabriela et al. "Recycling polystyrene into fuels by means of FCC: performance of various acidic catalysts," Applied Catalysis, B: Environmental (1998) 19(3,4), pp. 305-311.
Desai, J.D. "Plastic Waste Recycling Technologies—Ecofriendly Solution" Chemical Engineering World. 1999, 34(11), pp. 73-81.
Ding, Kuan et al. "Improving hydrocarbon yield from catalytic fast co-pyrolysis of hemicellulose and plastic in the dual-catalyst bed of CaO and HZSM-5," Bioresource Technology (2018) 261, pp. 86-92.
Dobo, Zsolt et al. "Transportation fuel from plastic wastes: Production, purification and SI engine tests," Energy (2019) 189, pp. 1-9.
El-Gamal, I.M. et al. "Nitrogen-based copolymers as wax dispersants for paraffinic gas oils," Fuel. 1998, 77(5), pp. 375-385.
Ercole, Piero et al. "Minimizing the environmental impact of Vehicles End of Life glass recycling," Verre (Paris, France). 2008,14(1) pp. 32-38.
Gala et al., Characterization and Distillation of Pyrolysis Liquids Coming from Polyolefins Segregated of MSW for their use as Automotive Diesel Fuel, Apr. 2020, Energy Fuels, 34: 5969-5982 (Year: 2020).
Gebauer, Manfred et al. "Olefine aus Altkunststoffen" (Olefins from waste plastics), Chemische Technik (1995) 47(4), pp. 196-199, with English abstract.
Ghosh et al., Dodecyl methacrylate and vinyl acetate copolymers as viscosity modifier and pout point depressants for lubricating oils, Apr. 2017, Int. J. Ind. Chem. 8:197-205 (Year 2017).
Hajekova, Elena et al. "Recycling of low-density polyethylene and polypropylene via copyrolysis of polyalkene oil/waxes with naphtha: product distribution and coke formation," Journal of Analytical and Applied Pyrolysis (2005) 74, (1-2), pp. 270-281.
Hofmann, U. et al. "Rohstoffrecycling—ein Weg zum Verwerten von Altkunststoffen," (Raw materials recycling—an approach to the reuse of scrap plastics) Kunststoffe (1993) 83,(4) pp. 259-263, with English abstract.
Kaminsky, W. "Recycling of mixed plastics by pyrolysis in a fluidised bed," Macromolecular Symposia (2000) 152, pp. 191-199.
Kaminsky, W. et al. "Feedstock recycling of polymers by pyrolysis in a fluidised bed," Polymer Degradation and Stability (2004) 85(3), pp. 1045-1050.
Ke-Jian, Liao et al. "A Study on Three Kinds of Alcohols Esterified Copolymer of Maleic Anhydride and Olefins as Pour-Point Depressant for Diesels," Petroleum Science and Technology (1998) 16(9, 10), pp. 971-977.
Kim, Su Jin "Comparison of Dimethylformamide with Dimethylsulfoxide for Quality Improvement of Distillate Recovered from Waste Plastic Pyrolysis Oil," Processes (2020) 8(1024), pp. 1-10.
Kodera, Yoichi et al. "Continuous-Distribution Kinetic Model for Macromolecular Conversion: Asphaltene and Polymer," Preprints of Symposia—American Chemical Society, Division of Fuel Chemistry (1998), 43(3), pp. 658-662.
Krishna, R. et al. "Correlation of Pour Point of Gas Oil and Vacuum Gas Oil Fractions with Compositional Parameters," Energy & Fuels. 1989, 3(1), pp. 15-20.
Lach, Christian "Chemical recycling: Turning plastic waste into chemical feedstock," BASF Research Press Conference Dec. 10, 2020, 9 pages.
Lange, Jean-Paul "Sustainable development: efficiency and recycling in chemicals manufacturing," Green Chemistry (2002) 4(6), pp. 546-550.

(56) References Cited

OTHER PUBLICATIONS

Lehner, Markus et al. "Prozesskette zum stofflichen Recycling von Kunststoffabfallen (Process Chain for the Material Recycling of Post-Consumer Plastic)," BHM (2016) 161(6), pp. 246-251, with English abstract.
Leube, Walter et al. "Wax-Crystal Modification for Fuel Oils by Self-Aggregating Partially Crystallizable Hydrocarbon Block Copolymers," Energy & Fuels. 2000, 14(2), pp. 419-430.
Lin, Y.-H et al. "A combined kinetic and mechanistic modelling of the catalytic degradation of polymers," Journal of Molecular Catalysis A: Chemical (2001) 171(1-2), pp. 143-151.
Lin, Y.-H et al. "A novel approach for the kinetic and mechanistic modeling of acid-catalyzed degradation of polymers," Asia-Pacific Journal of Chemical Engineering (2009) 4(2), pp. 147-153.
Lin, Y.-H et al. "Catalytic conversion of commingled polymer waste into chemicals and fuels over spent FCC commercial catalyst in a fluidised-bed reactor," Applied Catalysis B: Environment (2007) 69(3-4), pp. 145-153.
Lin, Yeuh-Hui et al. "Recycling of dual hazardous wastes in a catalytic fluidizing process," Catalysis Today (2011) 174 (1), pp. 37-45.
Lopez, A. et al. "Pyrolysis of municipal plastic wastes II: Influence of raw material composition under catalytic conditions," Waste Management (2011) 31, pp. 1973-1983.
Mariella, R.P. et al. "A Novel Sn1 Displacement: The Reaction of Tertiary Amines with Acetic Anhydride," Canadian Journal of Chemistry (1971) 49, pp. 3348-3351.
Meszaros, Mark W. "Advances in Plastics Recycling Thermal Depolymerization of Thermoplastic Mixtures," ACS Symposium Series (1995), 609(Plastics, Rubber, and Paper Recycling), pp. 170-182.
Miandad, R. et al. "Catalytic pyrolysis of plastic waste: A review," Process Safety and Environment Protection (2016) 102, pp. 822-838.
Miskolczi, N. et al. "Chemical Recycling of Waste Polyethylene and Polypropylene," Petroleum and Coal (2003) 45 (3-4), pp. 125-130.
Miskolczi, Norbert et al. "Hydrocarbon Mixtures from Waste Polymer Degradation," Progress in Rubber, Plastics and Recycling Technology (2004) 20(1), pp. 51-68.
Missau, Juliano et al. "Development of a nanostructured filter for pyrolysis wax purification: Effects of particulate filter aids," Particuology (2021) 54, pp. 164-172.
Moinuddin, Sarker et al. "High density polyethylene (HDPE) waste plastic conversion into alternative fuel for heavy vehicles," Journal of Environmental Research and Development (2012) 7(1), pp. 1-9.
Montrikool, O. et al. "Effects of maleic anhydride on degradation of PVC during pyrolysis," Journal of Analytical and Applied Pyrolysis. 2005, 73, pp. 77-84.
Nishino, Junya et al. "Development of a feedstock recycling process for converting waste plastics to petrochemicals," Ishikawajima-Harima Giho (2004) 44(1), pp. 325-332.
Ondruschka, Bernd et al. "Conversion of mixtures of pyrolysis feedstocks and thermochemical pre-treated plastic wastes. An alternative of raw material plastics recycling," Chemische Technik (Leipzig) (1995) 47(4), pp. 171-179, with English abstract.

* cited by examiner

COLD FLOW ADDITIVES FOR PLASTIC-DERIVED SYNTHETIC FEEDSTOCK

CROSS REFERENCE TO RELATED APPLICATIONS

This application claims the benefit of U.S. Provisional Patent Application Ser. No. 63/078,111, filed Sep. 14, 2020, and is a divisional of U.S. patent application Ser. No. 17/471,784, filed Sep. 10, 2021, the disclosures of which are incorporated by reference into the present application.

FIELD OF APPLICATION

The application is directed at improving the cold flow properties of synthetic feedstock from plastics.

BACKGROUND

Plastic is the fastest growing waste product and poses a significant environmental problem. Converting waste plastic into useful, higher value products such as crude oil or feedstock for the production of olefins in a steam cracker provides an opportunity to deal with the plastic waste problem.

Plastic is primarily made up of polyethylene and polypropylene. Through various processes such as pyrolysis, the carbon-carbon bonds and carbon-hydrogen bonds of the plastics are broken into shorter (oligomeric) chains. The resultant products from such processes can contain varying amounts of the oligomeric chains from the breakdown of the plastic that can be conformationally similar to wax molecules, such as paraffin and olefins.

The presence of these wax-like structures can result in solidifying or precipitating when the temperature drops, for example below 0° C. As additional wax precipitates, the crystals grow and, finally, if the temperature is decreased far enough, the crystals will grow together to form a three-dimensional network that immobilizes the fuel or oil. This solidification process is sometimes referred to as gelation. The precipitation of the wax can cause problems during the recovery, transport, storage or use of the synthetic feedstocks. The precipitated wax-like materials can block filters, pumps, pipelines, and other installations or be deposited in tanks, thus entailing additional cleaning.

Hence, additives that can depress or lower the pour points to maintain the fluidity of the synthetic feedstocks (e.g., fuel or oil) at lower temperatures are desired.

SUMMARY

Described herein are compositions and methods for improving the cold flow properties such as reducing or lowering the pour points of synthetic feedstocks from plastics.

In one aspect is a method of improving the cold flow properties of a plastic-derived synthetic feedstock composition comprising:

adding a pour point depressant to a plastic-derived synthetic feedstock composition.

In another aspect is a method of obtaining the synthetic feedstock comprising:

(a) heating plastic under substantially oxygen free conditions at a temperature of from about 400° C. to about 850° C. to produce a pyrolysis effluent;

(b) condensing the heated a pyrolysis effluent to obtain a synthetic feedstock; (c) recovering synthetic feedstock; and (d) adding a pour point depressant to the synthetic feedstock to lower the pour point.

In another aspect is a composition comprising a synthetic feedstock derived from plastic and a pour point depressant.

In yet another aspect is a composition comprising a pour point depressant and a synthetic feedstock, wherein the pour point depressant is a polymer added to the synthetic feedstock, the synthetic feedstock is provided by the method comprising:

(a) heating plastic under substantially oxygen free conditions at a temperature of from about 400° C. to about 850° C. to produce a pyrolysis effluent;

(b) condensing the heated a pyrolysis effluent to obtain a synthetic feedstock; and (c) recovering synthetic feedstock.

The pour point depressant is used to lower the temperature of the pour point of the synthetic feedstocks derived from plastics during recovery, transport, storage or use of the synthetic feedstocks.

DETAILED DESCRIPTION

Figure 1:
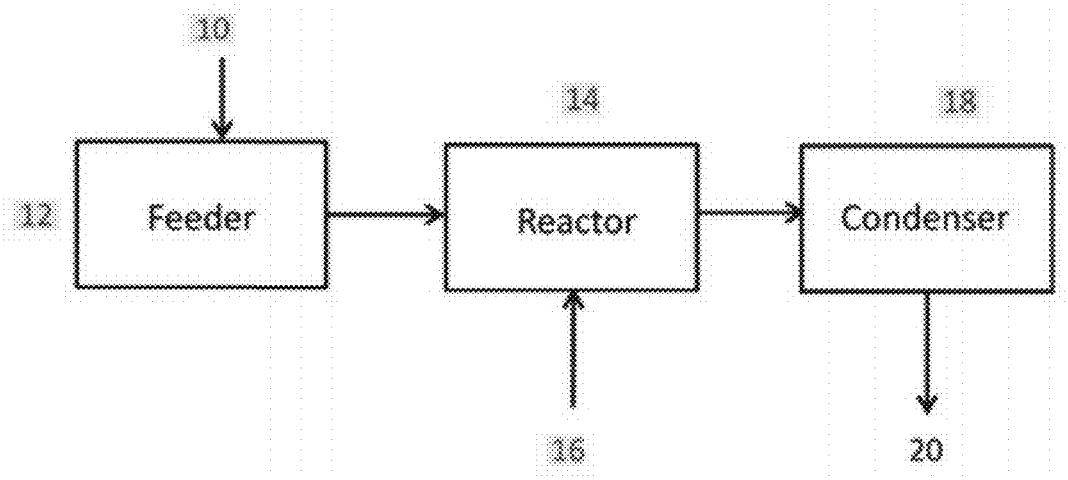
FIG. 1 is a schematic representation of an embodiment of a plastic pyrolysis process.
Figure 2:
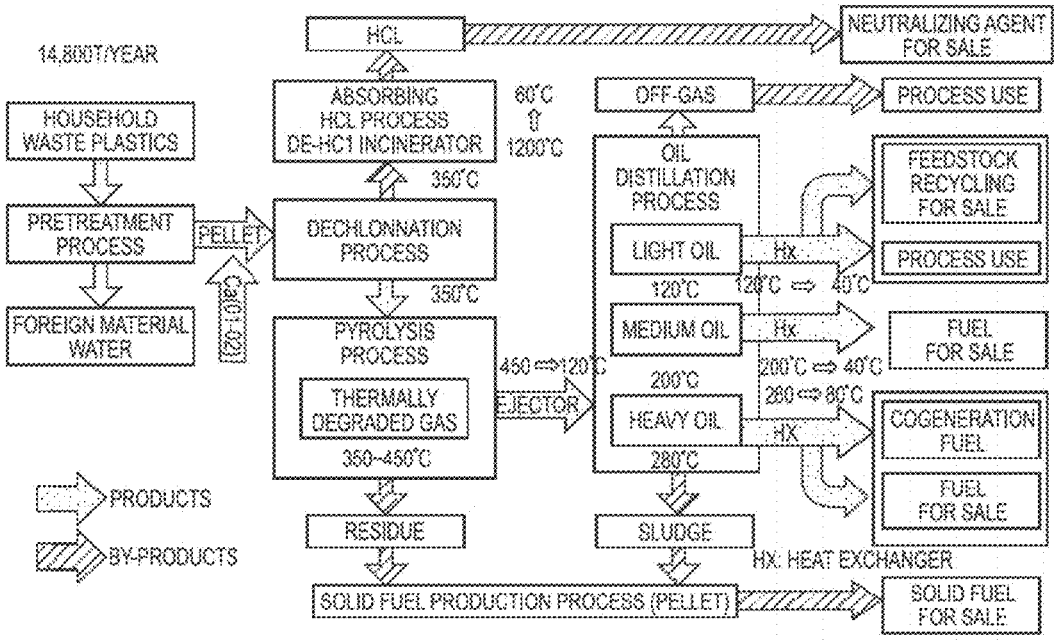
FIG. 2 is a schematic representation of an embodiment of a plastic pyrolysis process.

Although the present disclosure provides references to various embodiments, persons skilled in the art will recognize that changes may be made in form and detail without departing from the spirit and scope of the application. Various embodiments will be described in detail with reference to the figures. Reference to various embodiments does not limit the scope of the claims attached hereto. Additionally, any examples set forth in this application are not intended to be limiting and merely set forth some of the many possible embodiments for the appended claims.

Unless otherwise defined, all technical and scientific terms used herein have the same meaning as commonly understood by one of ordinary skill in the art. In case of conflict, the present document, including definitions, will control. Methods and materials are described below, although methods and materials similar or equivalent to those described herein can be used in practice or testing of the present application. All publications, patent applications, patents and other references mentioned herein are incorporated by reference in their entirety.

The terms "copolymer", "copolymerize" include not only polymers comprising two monomer residues and polymerization of two different monomers together respectively, but also includes copolymers comprising more than two monomer residues and polymerizing together more than two or more other monomers. Therefore, the term copolymer, for example, includes terpolymer; quadrapolymer; and polymers made from more than four different monomers, and/or polymers comprising, consisting of, or consisting essentially of two different monomer residues.

The term "pour point" is the lowest temperature at which a liquid will pour or flow under a specific set of conditions. Exemplary pour point standards include ASTM D97-11, D585311, and D5949-10.

The term "pour point depressants" or "PPDs" are polymers that reduce or inhibit wax crystal formation in feedstocks such as feedstocks derived from plastic, resulting in lower pour point and improved low or cold temperature flow performance.

The term "synthetic feedstock" refers to hydrocarbons obtained from treatment or processes on plastics. For example, the plastic can be thermally converted to e.g., pyrolysis oil or pyrolysate.

As used herein, the terms "comprise(s)," "include(s)," "having," "has," "can," "contain(s)," and variants thereof are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

As used herein, the term "optional" or "optionally" means that the subsequently described event or circumstance may but need not occur, and that the description includes instances where the event or circumstance occurs and instances in which it does not.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates or use formulations; through inadvertent error in these procedures; through differences in the manufacture, source, or purity of starting materials or ingredients used to carry out the methods, and like proximate considerations. The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities. Further, where "about" is employed to describe a range of values, for example "about 1 to 5" the recitation means "1 to 5" and "about 1 to about 5" and "1 to about 5" and "about 1 to 5" unless specifically limited by context.

As used herein, the term "substantially" means "consisting essentially of" and includes "consisting of" "Consisting essentially of" and "consisting of" are construed as in U.S. patent law. For example, a solution that is "substantially free" of a specified compound or material may be free of that compound or material, or may have a minor amount of that compound or material present, such as through unintended contamination, side reactions, or incomplete purification. A "minor amount" may be a trace, an unmeasurable amount, an amount that does not interfere with a value or property, or some other amount as provided in context. A composition that has "substantially only" a provided list of components may consist of only those components, or have a trace amount of some other component present, or have one or more additional components that do not materially affect the properties of the composition. Additionally, "substantially" modifying, for example, the type or quantity of an ingredient in a composition, a property, a measurable quantity, a method, a value, or a range, employed in describing the embodiments of the disclosure, refers to a variation that does not affect the overall recited composition, property, quantity, method, value, or range thereof in a manner that negates an intended composition, property, quantity, method, value, or range. Where modified by the term "substantially" the claims appended hereto include equivalents according to this definition.

As used herein, any recited ranges of values contemplate all values within the range and are to be construed as support for claims reciting any sub-ranges having endpoints which are real number values within the recited range. By way of example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

Described are compositions and methods that improve the cold flow properties of synthetic feedstocks from plastics. The cold flow properties can be improved by additives that prevent the formation of wax-like structures and lower the temperature at which the synthetic feedstock solidifies. This addition in turn ensures uninterrupted flow of the synthetic feedstock. Such additives are referred to as pour point depressants or flow improvers.

Several processes are known in which plastic (e.g., waste plastic) is converted to lower molecular weight hydrocarbon materials particularly to hydrocarbon fuel materials. For example, see U.S. Pat. Nos. 6,150,577; 9,200,207; and 9,624,439; each of these publications incorporated herein by reference in their entireties.

Such processes broadly described include breaking the long-chain plastic polymers by pyrolysis-high heat (e.g., from 400° C.-850° C.) with limited or no oxygen and above atmospheric pressure. The resultant pyrolysis effluent is distilled and then condensed. As shown in FIG. 1, an embodiment of a pyrolysis process includes a feeder 12 of waste plastic, a reactor 14, and a condenser system 18. Polymer-containing material is fed through inlet 10 in the feeder, and heat is applied to reactor 14. An outlet 20 from condenser system 18 allows for the product to exit.

The thermal cracking reactors to accomplish this pyrolysis reaction have been described in detail in a number of patents, e.g., U.S. Pat. Nos. 9,624,439; 10,131,847; 10,208,253; and PCT International Pat. Appl. Pub. No. WO 2013/123377A1, each of these publications incorporated herein by reference in their entireties.

In some embodiments, the method of obtaining the synthetic feedstock comprises:

(a) heating plastic under substantially oxygen free conditions at a temperature of from about 400° C. to about 850° C. to produce a pyrolysis effluent;

(b) condensing the heated a pyrolysis effluent to obtain a synthetic feedstock;

(c) recovering synthetic feedstock

In some embodiments, the method of obtaining the synthetic feedstock is in the presence or absence of catalysts.

The pyrolysis reaction produces a range of hydrocarbon products from gases (at temperatures from 10° C. to 50° C. and 0.5-1.5 atmospheric pressure and having 5 carbons or less); modest boiling point liquids (like gasoline (40-200° C.) or diesel fuel 180-360° C.); a higher (e.g., at 250-475° C.) boiling point liquid (oils and waxes), and some solid residues, commonly referred to as char. Char is the material that is left once the pyrolytic process is complete and the fuel recovered. Char contains the additives and contaminants that enter the system as part of the feedstock. The char can be a powdery residue or substance that is more like sludge with a heavy oil component. Glass, metal, calcium carbonate/oxide, clay and carbon black are just a few of the contaminants and additives that will remain after the conversion process is complete and become part of the char.

Various plastic types such a thermoplastic and thermoset waste plastics can be used in the above-described process. The types of plastics commonly encountered in waste-plastic feedstock include, without limitation, low-density polyethylene, high-density polyethylene, polypropylene, polystyrene, nylons, and the like, and combinations thereof.

In some embodiments, the pyrolysis reaction (e.g., pyrolysis effluent) results in 2-30% gas (C1-C4 hydrocarbon); (2) 10-50% oil (C5-C15 hydrocarbon); (3) 10-40% waxes (≥C16 hydrocarbon); and (4) 1-5% char and tar. After completion of the pyrolysis process, the pyrolysate or pyrolysis oil can range from 20-85% oils (C5-C15) and 15-95% waxes (≥C16) or from 35-80% oils (C5-C15) and 20-65% waxes (≥C16).

The hydrocarbons that derive from the pyrolysis of waste plastic are a mixture of alkanes, alkenes, olefins and diolefins; the olefin group is generally between C1 and C2, i.e. alpha-olefin, but some alk-2-ene is also produced, the diene is generally in the alpha and omega position, i.e. alk-α,ω-diene; or the dienes are conjugated dienes. In some embodiments, the pyrolysis of plastic produces paraffin compounds, isoparaffins, olefins, diolefins, naphthenes and aromatics.

In some embodiments, the percentage of 1-olefins in the pyrolysis effluent is from 25 to 75% wt; from 40-60 wt %. Pyrolysis conditions include a temperature from about 400-850° C., from about 500-700° C., or from about 600-700° C.

Depending on the processing conditions synthetic feedstock having characteristics similar to crude oil from petroleum sources but can have ash and wax of different ranges. In some embodiments, the synthetic feedstock derived from waste plastic contains waxy hydrocarbons from C16-C36; C16-C20; C21-C29; or C30-C36. In other embodiments, the synthetic feedstock derived from waste plastic contains waxy hydrocarbons with the C16-C20 fraction representing 50-60% of the wax molecules, the C21-C29 fraction being about 40-50% of the waxy molecules and C30+ fraction being less than 2% of the wax fraction; the waxy fraction is about 10-20% of the recovered synthetic feedstock fraction. In still other embodiments, the synthetic feedstocks have 15-20 wt % C9-C16; 75-87% C16-C29; 2-5% C30+, where the carbon chains are predominantly a mixture of alkanes, alkenes and diolefins. In other embodiments, the synthetic feedstocks have 10 wt %<C12, 25 wt % C12-C20, 30 wt % C21-C40 and 35 wt %>C41, where the carbon chains are predominantly a mixture of alkanes, alkenes and diolefins.

Unlike the synthetic feedstock derived from plastics, conventional crude oil that suffers from pour point issues has a broad range of hydrocarbon species where the non-waxy components may help offset some of the waxy nature of these troublesome crude oils. In a conventional waxy crude oil, the waxy components range from C16 to C80+. In one example of a crude, the waxy molecules with a carbon chain range of C22-C40, display a roughly Gaussian distribution and the majority of the waxy molecules were in the C28-C36 range. In another example of a crude, the waxy carbon chain length ranged from C15 to C110, the distribution can be bimodal with the majority of the waxy molecules being in the C24 to C28 or C36 to C52 range.

While there are known dewaxing methods for reducing waxy feeds, either by solvent removal or catalytic dewaxing or isomerization, most of these processes are expensive. Disclosed herein are pour point depressants that lower pour points of synthetic feedstocks derived from plastics (e.g., waste plastic).

In some embodiments, the synthetic feedstock composition has waxy constituents which can precipitate from the synthetic feedstock composition at a temperature greater than its desired or intended storage, transport, or use temperature. In some embodiments, the synthetic feedstock composition can have a wax content greater than 1 weight percent; greater than 5 weight percent; or greater than 10 weight percent. In some embodiments the wax content in the synthetic feedstocks is, 5-95 weight percent; 15-95 weight percent; 20-65 weight percent; 5-40 weight percent; 5-30 weight percent; from 10-25 weight percent; 15-20 weight percent; 10-20 weight percent; or 10-30 weight percent.

In some embodiments, the compounds used in the compositions and methods for lowering or depressing the pour points of synthetic feedstock are polymers (e.g., synthetic). In some embodiments, the polymers are vinyl carboxylic acid ester polymers. In some embodiments the pour point depressants are polymers such as ethylene vinyl acetate, vinyl acetate-acrylate copolymers, alpha olefin maleic anhydride polymers or combinations thereof.

In some embodiments, the pour depressant is a copolymer of ethylene. In some embodiments the copolymer of ethylene is with at least one ethylenically unsaturated monomer, wherein the ethylenically unsaturated monomer is a vinyl carboxylic acid ester.

In some embodiments, vinyl carboxylic esters are, the vinyl esters of carboxylic acids having 2 to 20 carbon atoms, the hydrocarbon radical of which may be linear or branched. Among the carboxylic acids with a branched hydrocarbon radical, some are those whose branching is in the α-position to the carboxyl group, the α-carbon atom being particularly preferably tertiary, i.e., the carboxylic acid being a so-called neocarboxylic acid. In some embodiments, the hydrocarbon radical of the carboxylic acid is linear.

Examples of suitable vinyl carboxylic esters are vinyl acetate, vinyl propionate, vinyl butyrate, vinyl neopentanoate, vinyl hexanoate, vinyl neononanoate, vinyl neodecanoate. In other embodiments the ethylene copolymer is acrylonitrile, or alpha-olefins such as octane, butane, propylene, comb polymers with alkyl side chains such as methacrylate ester copolymers, maleic-olefinic ester copolymers, and maleic-olefinic amide copolymers; and branched copolymers having alkyl side chains such as alkylphenol-formaldehyde copolymers and polyethyleneimines and the like. In some embodiments, the pour point depressant is an ethylene vinyl acetate copolymer.

Also suitable are copolymers which contain two or more mutually different alkenyl carboxylic acid esters in copolymerized form, these differing in the alkenyl function or in the carboxylic acid group. Also suitable are copolymers which, in addition to the alkenyl carboxylic ester (s), contain at least one olefin or at least one (meth) acrylic acid ester in copolymerized form.

Suitable olefins are, for example, those having 3 to 10 carbon atoms and having 1 to 3, 1 or 2, or having one carbon-carbon double bond. In the latter case, the carbon-carbon double bond can be arranged both terminally (α-olefin), internally, or both. In some embodiments the α-olefins have 3 to 6 carbon atoms, such as propene, 1-butene, 1-pentene and 1-hexene.

Suitable (meth) acrylic esters are, for example, esters of (meth) acrylic acid with C1-C 10-alkanols, in particular with methanol, ethanol, propanol, isopropanol, n-butanol, sec-butanol, isobutanol, tert-butanol, pentanol, hexanol, Heptanol, octanol, 2-ethylhexanol, nonanol and decanol.

In some embodiments the vinyl acetate in the ethylene vinyl acetate copolymer is from 5-60 wt % of the total copolymer; or from 10 to 25 wt %; from 10 to 20 wt %; from 10 to 50 wt %; from 25 to 40 wt %; from 25 to 50 wt %; or from 15 to 25 wt %.

In some embodiments, the copolymer has a molecular weight from 800 to 13,000 g/mol; from 900 to 12,000 g/mol; or from 900-10,000 g/mol. In some embodiments, the molecular weight can be determined by gel permeation chromatography (GPC).

In some embodiments, the ethylene vinyl acetate copolymers used as pour point depressants on synthetic feed stock derived from plastics are present with or without a synergist. In some embodiments the synergist is alpha olefin maleic anhydride. In still other embodiments, the ethylene vinyl acetate is about 900-12,000 molecular weight provided with a solvent and having 10-50 percent vinyl acetate content and 20-70 percent actives.

In some embodiments the copolymers are at least one ethylenically unsaturated monomer, wherein the ethylenically unsaturated monomer is a vinyl carboxylic acid ester.

In some embodiments, vinyl carboxylic esters are, the vinyl esters of carboxylic acids having 2 to 20 carbon atoms, the hydrocarbon radical of which may be linear or branched. Among the carboxylic acids with a branched hydrocarbon radical, some are those whose branching is in the α-position to the carboxyl group, the α-carbon atom being particularly tertiary, i.e., the carboxylic acid being a so-called neocarboxylic acid. In some embodiments, the hydrocarbon radical of the carboxylic acid is linear.

Examples of suitable vinyl carboxylic esters are vinyl acetate, vinyl propionate, vinyl butyrate, vinyl neopentanoate, vinyl hexanoate, vinyl neononanoate, vinyl neodecanoate. In some embodiments, the vinyl carboxylic ester is copolymerized with an acrylate.

In some embodiments the acrylates are acrylate esters. In some embodiments, the acrylate esters are of C1-C20-alkanols, such as methyl acrylate, ethyl acrylate, propyl acrylate, isopropyl acrylate, n-butyl acrylate, isobutyl acrylate, tert-butyl acrylate, n-pentyl acrylate, neopentyl acrylate, hexyl acrylate, heptyl acrylate, octyl acrylate, neooctyl acrylate, 2-ethylhexyl acrylate, nonyl acrylate, neononyl acrylate, decyl acrylate, neodecyl acrylate, lauryl acrylate, palmityl acrylate and stearyl acrylate; also the corresponding methacrylic, crotonic and isocrotonic esters are used.

In some embodiments, the pour point depressant is a vinyl acetate-acrylate copolymer.

In some embodiments the vinyl acetate in the vinyl acetate-acrylate copolymer is from 5-30 wt % of the total copolymer; from 8-20 wt %; 10 to 25 wt %; or from 10 to 20 wt %.

In some embodiments, the copolymer has a molecular weight from 800 to 13,000 g/mol; from 900 to 12,000 g/mol; or from 900-10,000 g/mol; or from 900-9300 g/mol. In some embodiments, the molecular weight can be determined by gel permeation chromatography (GPC).

In some embodiments, the vinyl acetate-acrylate copolymers are used as pour point depressants on synthetic feed stock derived from plastics. In some embodiments the vinyl acetate-acrylate is about 900-12,000 molecular weight provided with a solvent and having 8-20 percent vinyl acetate content and 20-70 percent actives.

In some embodiments, the pour depressant is a copolymer of an alpha-olefin monomer with an ethylenically unsaturated carboxylic acid monomer or derivatives thereof such as fumaric acid, maleic anhydride, maleic acid, (meth) acrylic acid, itaconic anhydride or itaconic acid, maleimide and N-alkyl, N-aryl, and N-alkaryl maleimides, substituted moiety such as citraconic anhydride, citraconimide and N-alkyl, N-aryl, and N-alkaryl citraconimides or ccombinations thereof. In some embodiments, the ethylenically unsaturated carboxylic acid or derivatives thereof may be an acid or anhydride or derivatives thereof. In some embodiments, the ethylenically unsaturated carboxylic acid monomer is maleic anhydride monomer having the formula (I):

(I)

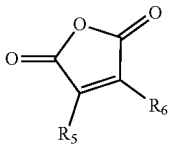

wherein $R_5$ and $R_6$ are independently selected from hydrogen or C1-C30 alkyl. In some embodiments, the maleic anhydride residue is further reacted with about 0.01 to 2.0 equivalents of a C12-C60 alkanol or amine per equivalent of anhydride.

In some embodiments, the one or more alpha olefin monomers having the formula (II):

(II)

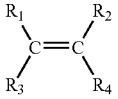

wherein $R_1$, $R_2$, $R_3$, and $R_4$ are independently selected from hydrogen and C5-C40 alkyl.

In some embodiments, the alpha olefin contains from 15-40 carbon atoms or 18-36 or 20-35 carbon atoms.

In some embodiments, the olefin is linear and/or contains linear hydrocarbon chains such as alkyl or alkaryl chains attached to the double bond, then polymers of the olefin including copolymers of the olefin have pendant side chains. For example, polymers of linear alpha olefins having 14 carbon atoms or more, when polymerized and/or copolymerized, impart linear side chains of 12 carbon atoms or more to the resulting polymer. Long-chain alkenes, wherein the double bond is not in the 1-position, are also suitable because when polymerized the resulting polymer of the alkene monomer has linear side chains of at least 12 carbon atoms. Polymers of long chain alkenes with 12 carbon atoms or more on one side of the double bond and 12 carbon atoms or more on the opposing side of the double bond, when polymerized and/or copolymerized, form brush polymers. Such brush polymers have sets of opposing pendant side chains. Both brush and comb polymers are both useful in the disclosed embodiments.

In some embodiments, the pour point depressant is an alpha olefin-maleic anhydride copolymer (OMAC). In some embodiments, the copolymer of formula (I) and formula (II) is further reacted via the maleic anhydride residue with one or more alkanol or amine compounds to form the corresponding carboxylate or amide functionalities. In some such embodiments, the maleic anhydride residue is reacted with about 0.5 to 2.0 equivalents of the alkanol or amine per equivalent of anhydride. The alkanol or amine compounds are linear, branched, aromatic, or alkaromatic compounds having about 12 to 60 carbons.

In some embodiments the alpha-olefin maleic anhydride copolymer is from 10,00-70,000 g/mol; 10,00-55,000 g/mol; 20,00-50,000 g/mol; 20,00-70,000 g/mol or from 15,000-

35,000 g/mol. In some embodiments, the molecular weight can be determined by gel permeation chromatography (GPC).

In some embodiments, the alpha-olefin maleic anhydride copolymer used as pour point depressants on synthetic feed stock derived from plastics is about 20,00-70,000 g/mol molecular weight provided with a solvent and having 20-90 percent actives.

Preparation of pour point depressant polymers may be made by any method known in the art such as by solution polymerization of free radical initiation or high-pressure polymerizations that may be carried out in an autoclave or suitable reactor. For example, preparation of alpha-olefin with an ethylenically unsaturated carboxylic acid (e.g., alpha-olefin maleic anhydride copolymers are known in the art. For example, see U.S. Pat. No. 5,441,545, which is incorporated herein by reference.

In some embodiments, the pour point depressant is formulated with solvents such as water, alcohols, aromatics, naphthenic, aliphatic and non-polymeric ester compounds (as disclosed in U.S. application Ser. No. 15/399,025 (U.S. Pat. Appl. Pub. No 2017/0190949, which is incorporated herein by reference in its entirety) and combinations thereof. In some embodiments, the solvents are heavy aromatic naphtha or light aromatic naphtha solvents.

In some embodiments the solvents are 10 wt % to 99 wt % of the pour point depressant; 10-25 wt %; 20-50 wt %; 30-75 wt %; 50-75%; 75-100 wt % of the pour point depressant.

In some embodiments, the pour point depressants are 20-99% active; 50-75%; 60-70%; 75-99% active; 20-90%; 20-70%; 30-70%; 20-50%; or 20-30% active.

In some embodiments, the pour point depressants are provided neat (viz., without a solvent). In some embodiments, the pour point depressants are provided as a concentrate. In some embodiments the pour point depressant concentrates have 1 wt % to 20 wt % pour point depressant (PPD), or about 3 wt % to 20 wt %, or about 5 wt % to 20 wt %, or about 7 wt % to 20 wt %, or about 10 wt % to 20 wt % PPD.

In some embodiments, the pour point depressant can include one or more additional components such other pour point depressants, paraffin inhibitors, asphaltene dispersants, wax dispersants, tar dispersants, neutralizers (e.g., amine neutralizers), surfactants, biocides, preservatives, stabilizers and the like or any combination thereof.

Wax dispersants can stabilize paraffin crystals which have formed and prevent them from sedimenting. The wax dispersants used may be, for example, alkylphenols, alkylphenol-formaldehyde resins or dodecylbenzenesulfonic acid.

The method of applying the pour point depressant to the synthetic feedstock is not particularly limited. One of skill will appreciate that the synthetic feedstock additives such as the pour point depressant are conventionally added by using available equipment including e.g., pipes, mixers, pumps, tanks, injection ports, and the like.

In some embodiments, the pour point depressant is added into a synthetic feedstock obtained from plastics. In some embodiments, the pour point depressant is an ethylene vinyl acetate copolymer. In other embodiments, the pour point depressant is added to a synthetic feedstock that contains waxes. In still other embodiments, ethylene vinyl acetate copolymer, vinyl acetate-acrylate copolymer, alpha olefin maleic anhydride copolymer or combinations thereof are added to a synthetic feedstock that contains waxes, char and tar. In some embodiments, the ethylene vinyl acetate copolymer, vinyl acetate-acrylate copolymer, alpha olefin maleic anhydride copolymer or combinations thereof are added to a synthetic feedstock that contains waxes having C16-C36. In some embodiments, the ethylene vinyl acetate copolymer, vinyl acetate-acrylate copolymer, alpha olefin maleic anhydride copolymer or combinations thereof are suitable pour points for synthetic feedstock having from 20-85% oils (C5-C15) and 15-95% waxes (≥C16); or from 35-80% oils (C5-C15) and 20-65% waxes (≥C16); or 15-20 wt % C9-C16; 75-87% C16-C29; 2-5% C30+, where the carbon chains are predominantly a mixture of alkanes, alkenes and diolefins. In still other embodiments, the ethylene vinyl acetate copolymer, vinyl acetate-acrylate copolymer, alpha olefin maleic anhydride copolymer or combinations thereof are suitable pour points for synthetic feedstock having 10 wt %<C12, 25 wt % C12-C20, 30 wt % C21-C40 and 35 wt %>C41, where the carbon chains are predominantly a mixture of alkanes, alkenes and diolefins.

While an effective amount of the pour point depressant used depends on a number of factors such as the local operating conditions, the type of synthetic feedstock obtained from the plastic type processed, the temperature and other characteristics of the process, in some embodiments, the pour point depressant is used from 50 ppm to 10,000 ppm; 50 ppm to 5,000 ppm; 550 ppm to 5,000 ppm; 250 ppm to 1000 ppm; 50 ppm to 1,000 ppm; 150 to 450 ppm; 50 ppm to 500 ppm in the synthetic feedstock.

Flow properties of the synthetic feedstock can be evaluated by any known method or test. For example, pour points can be measured according to ASTM D97.

In some embodiments the synthetic feedstock with the pour point depressants have pour points (measured under ASTM D97) of less than −24° C., less than −20° C.; less than −10° C., less than −5° C. Such synthetic feedstock continues to flow thereby being allowed to be poured, pumped or transferred at temperatures between, for example −40° C. to 20° C. In some embodiments, the compositions containing the pour point depressants flow, and thus are pourable or pumpable, at temperatures as low as −40° C., or −40° C. to 20° C.; to −40° C., or −5° C. to −40° C., or −10° C. to −40° C., or −15° C. to −40° C., or −20° C. to −40° C., or −25° C. to −40° C., or −30° C. to −40° C.

In some embodiments the pour point depressants reduce the pour points by 3 to 42° C.; 3 to 30° C.; 3 to 20° C.; 10 to 20° C.; by 3° C. to 20° C.; 3° C. to 15° C.; 3° C. to 10° C.; or 3° C. to 5° C.

In some embodiments the pour point depressants at 250-450 ppm reduce the pour points by 3 to 42° C.; 3 to 30° C.; 3 to 20° C.; 10 to 20° C.; by 3° C. to 20° C.; 3° C. to 15° C.; 3° C. to 10° C.; or 3° C. to 5° C.

In some embodiments, the compositions comprise, consist essentially of, or consist of ethylene vinyl acetate copolymer, vinyl acetate-acrylate copolymer, alpha olefin maleic anhydride copolymer or combinations thereof in synthetic feedstock. In such embodiments, the pour points are reduced from 3 to 42° C.; when 50 ppm to 10,000 ppm are added to the synthetic feedstock derived from plastics.

The application is further described below with additional non-limiting embodiments:

1. A method of improving the cold flow properties of a plastic-derived synthetic feedstock composition comprising:
   adding a pour point depressant to a plastic-derived synthetic feedstock composition.
2. The method of embodiment 1, wherein the synthetic feedstock composition further comprises other pour point dispersants, paraffin inhibitors, asphaltene dispersants, wax dispersants, tar dispersants, neutralizers, surfactants, biocides, preservatives, stabilizers or any combination thereof.

3. The method as in one of embodiments 1-2, wherein the synthetic feedstock comprises from 20-85% oils (C5-C15) and 15-95% waxes (≥C16); or from 35-80% oils (C5-C15) and 20-65% waxes (≥C16).
4. The method as in one of embodiments 1-3, wherein the waxes comprise C16-C36.
5. The method as in one of embodiments 1-4, wherein the pour point depressant is a polymer.
6. The method as in one of embodiments 1-5, wherein the pour point depressant is a synthetic polymer.
7. The method as in one of embodiments 1-6 wherein the polymer comprises a vinyl carboxylate.
8. The method as in one of embodiments 1-7, wherein the pour point depressant is an ethylene vinyl acetate copolymer or a vinyl acetate-acrylate copolymer or combinations thereof.
9. The method as in one of embodiments 1-8, wherein the pour point depressant is an alpha olefin maleic anhydride.
10. The method as in one of embodiments 1-9, wherein the pour point depressant is added to the synthetic feedstock composition from about 50 ppm to 5000 ppm.
11. The method as in one of embodiments 1-10, wherein the pour point depressant lowers the pour point of the synthetic feedstock composition by 3° C. to 42° C.
12. The method as in one of embodiments 1-11, wherein the synthetic feedstock composition comprises a pour point depressant has a pour point less than −24° C.
13. A method of obtaining the synthetic feedstock comprising:
    (a) heating plastic under substantially oxygen free conditions at a temperature of from about 400° C. to about 850° C. to produce a pyrolysis effluent;
    (b) condensing the heated a pyrolysis effluent to obtain a synthetic feedstock; (c) recovering synthetic feedstock; and
    (d) adding a pour point depressant to the synthetic feedstock to lower the pour point.
14. The method of embodiment 13, wherein the plastic comprises waste plastic.
15. The method as in one of embodiments 13-14, wherein the heating is in the presence or absence of a catalyst.
16. The method as in one of embodiments 13-15, wherein the plastic comprises polyethylene, polypropylene, polyvinylchloride, polystyrene, polyethylene terephthalate and combinations thereof.
17. The method as in one of embodiments 13-16, wherein the synthetic feedstock comprises from 20-85% oils (C5-C15) and 15-95% waxes (≥C16); or from 35-80% oils (C5-C15) and 20-65% waxes (≥C16).
18. The method as in one of embodiments 13-17, wherein the waxes comprise C16-C36.
19. The method as in one of embodiments 13-18, wherein the pour point depressant is a polymer.
20. The method as in one of embodiments 13-19, wherein the pour point depressant is a synthetic polymer.
21. The method as in one of embodiments 13-20, wherein the polymer comprises a vinyl carboxylate.
22. The method as in one of embodiments 13-21, wherein the pour point depressant is an ethylene vinyl acetate copolymer or a vinyl acetate-acrylate copolymer or combinations thereof.
23. The method as in one of embodiments 13-22, wherein the pour point depressant is an alpha olefin maleic anhydride.
24. The method as in one of embodiments 13-23, wherein the pour point depressant is an ethylene vinyl acetate copolymer.
25. The method as in one of embodiments 13-24, wherein the pour point depressant is added to the synthetic feedstock from about 50 ppm to 5000 ppm.
26. The method as in one of embodiments 13-25, wherein the pour point depressant lowers the pour point of the synthetic feedstock by 3° C. to 42° C.
27. The method as in one of embodiments 13-26, wherein the synthetic feedstock comprising a pour point depressant has a pour point less than −24° C.
28. A composition comprising a synthetic feedstock derived from plastic and a pour point depressant.
29. The composition of embodiment 27, wherein the synthetic feedstock comprises from 20-85% oils (C5-C15) and 15-95% waxes (≥C16); or from 35-80% oils (C5-C15) and 20-65% waxes (≥C16).
30. The composition as in one of embodiments 27-28, wherein the waxes comprise C16-C36.
31. The composition as in one of embodiments 27-29, wherein the pour point depressant comprises a polymer.
32. The composition as in one of embodiments 27-30, wherein the pour point depressant comprises a synthetic polymer.
33. The composition as in one of embodiments 27-31, wherein the pour point depressant comprises a vinyl carboxylate.
34. The composition as in one of embodiments 27-32, wherein the pour point depressant is an ethylene vinyl acetate copolymer or a vinyl acetate-acrylate copolymer or combinations thereof.
35. The composition as in one of embodiments 27-33, wherein the pour point depressant is an alpha olefin maleic anhydride.
36. The composition as in one of embodiments 27-34, wherein the pour point depressant is added to the synthetic feedstock from about 50 ppm to 5000 ppm.
37. The composition as in one of embodiments 27-35, wherein the pour point depressant lowers the pour point of the synthetic feedstock by 3° C. to 42° C.
38. The composition as in one of embodiments 27-36, wherein the synthetic feedstock comprising a pour point depressant has a pour point less than −24° C.
39. A composition comprising a pour point depressant and a synthetic feedstock, wherein the pour point depressant is a polymer added to the synthetic feedstock, the synthetic feedstock is provided by the method comprising:
    (a) heating plastic under substantially oxygen free conditions at a temperature of from about 400° C. to about 850° C. to produce a pyrolysis effluent;
    (b) condensing the heated a pyrolysis effluent to obtain a synthetic feedstock; and
    (c) recovering synthetic feedstock.
40. The composition of embodiment 38, wherein the synthetic feedstock comprises from 20-85% oils (C5-C15) and 15-95% waxes (≥C16); or from 35-80% oils (C5-C15) and 20-65% waxes (≥C16).
41. The composition as in one of embodiments 38-39, wherein the waxes comprise C16-C36.
42. The composition as in one of embodiments 38-40, wherein the pour point depressant comprises a polymer.

43. The composition as in one of embodiments 38-41, wherein the pour point depressant comprises a synthetic polymer.
44. The composition as in one of embodiments 38-42, wherein the pour point depressant comprises a vinyl carboxylate.
45. The composition as in one of embodiments 38-43, wherein the pour point depressant comprises an ethylene vinyl acetate copolymer or a vinyl acetate-acrylate copolymer or combinations thereof.
46. The composition as in one of embodiments 38-44, wherein the pour point depressant comprises an alpha olefin maleic anhydride.
47. The composition as in one of embodiments 38-45, wherein the pour point depressant is added to the synthetic feedstock from about 50 ppm to 5000 ppm.
48. The composition as in one of embodiments 38-46, wherein the pour point depressant lowers the pour point of the synthetic feedstock by 3° C. to 42° C.
49. The composition as in one of embodiments 38-47, wherein the synthetic feedstock comprising a pour point depressant has a pour point less than −24° C.
50. Use of the pour point depressants as in one of embodiments 1-48 to lower the pour point of synthetic feedstocks derived from plastics.

EXAMPLES

The following examples are intended to illustrate different aspects and embodiments of the application and are not to be considered limiting the scope. It will be recognized that various modifications and changes may be made without departing from the scope of the application and claims.

Example 1 Cold Flow Additives in Synthetic Feedstock Derived from Plastic

The pour points of synthetic feedstock derived from plastic with various pour point depressants were determined according to ASTM D97. The synthetic feedstocks having the following carbon chains were used: Sample 1: 15-20 wt % C9-C16; 75-87% C16-C29; 2-5% C30+, where the carbon chains are predominantly a mixture of alkanes, alkenes and diolefins; and Sample 2 10 wt %<$C_{12}$, 25 wt % $C_{12}$-$C_{20}$, 30 wt % $C_{21}$-$C_{40}$ and 35 wt %>$C_{41}$.

The chemistries of the various pour point depressants used are shown below in Table 1:

TABLE 1

| Category No. | Chemistry-type | MW range (by GPC) | Vinyl acetate content | Active Content |
|---|---|---|---|---|
| 1 | ethylene-vinyl acetate copolymer | 900-12,000 g/mol | 10-50% | 20-70% |
| 2 | ethylene-vinyl acetate copolymer with alpha-olefin maleic anhydride-based synergist | 900-12,000 g/mol | 10-50% | 20-70% |

TABLE 1-continued

| Category No. | Chemistry-type | MW range (by GPC) | Vinyl acetate content | Active Content |
|---|---|---|---|---|
| 3 | alpha-olefin-maleic anhydride-based copolymer (C18-C36) | 20,00-70,000 g/mol | NA | 20-90% |
| 4 | vinyl acetate-acrylate copolymer | 900-9,300 | 8-20% | 30-70% |

Table 2 shows the different categories of pour point depressants tested at varying dosages in Sample 1.

TABLE 2

| Additive | Treat Rate, ppm | Pour Point,° C. |
|---|---|---|
| Blank | 0 | 9 |
| | Category 1-Sample 1 | |
| A | 250 | 9 |
| A | 500 | 3 |
| A | 1000 | −9 |
| A | 2000 | <−12 |
| A | 4000 | <−24 |
| B | 200 | −3 |
| B | 400 | −12 |
| B | 600 | −21 |
| B | 800 | <−21 |
| B | 1000 | <−21 |
| G | 400 | −6 |
| K | 400 | −3 |
| | Category 2-Sample 1 | |
| E | 400 | −12 |
| F | 400 | 6 |
| I | 400 | −6 |
| J | 400 | 3 |
| | Category 3-Sample 1 | |
| C | 2000 | 0 |
| C | 4000 | −6 |
| H | 4000 | 9 |
| | Category 4-Sample 1 | |
| D | 2000 | −3 |
| D | 4000 | −3 |

Table 2 showed that while all four categories of pour point depressants tested in Sample 1 showed promising pour point depression, ethylene-vinyl acetate copolymers were the most effective at lower dosage ranges.

Table 3 shows the different categories of pour point depressants tested at varying dosages in Sample 2.

TABLE 3

| Additive | Treat Rate, ppm | Pour Point,° C. |
|---|---|---|
| Blank | 0 | 9 |
| | Category 1-Sample 2 | |
| B | 200 | 6 |
| B | 400 | 6 |
| B | 600 | 3 |
| B | 800 | 0 |

TABLE 3-continued

| Additive | Treat Rate, ppm | Pour Point,° C. |
|---|---|---|
| | Category 3-Sample 2 | |
| C | 800 | −9 |
| H | 800 | −6 |
| L | 800 | −9 |
| | Category 2-Sample 2 | |
| F | 800 | 3 |
| | Category 4-Sample 2 | |
| D | 800 | −9 |

Table 3 showed that while all categories of pour point depressants tested in Sample 2 showed promising pour point depression, alpha-olefin-maleic anhydride-based copolymers and vinyl acetate-acrylate copolymers were the most effective at lower dosage ranges.

What is claimed is:

1. A method of obtaining a synthetic feedstock, comprising:

(a) heating plastic under substantially oxygen free conditions at a temperature of from about 400° C. to about 850° C. to produce a pyrolysis effluent;

(b) condensing the heated pyrolysis effluent to obtain a synthetic feedstock;

(c) recovering the synthetic feedstock; and (d) adding a pour point depressant to the synthetic feedstock to lower the pour point, wherein the pour point depressant comprises an ethylene vinyl acetate copolymer and an alpha olefin maleic anhydride polymer.

2. The method of claim 1, wherein the plastic comprises waste plastic.

3. The method of claim 1, wherein the heating is in the presence or absence of a catalyst.

4. The method of claim 1, wherein the plastic comprises polyethylene, polypropylene, polyvinylchloride, polystyrene, polyethylene terephthalate, or a combination thereof.

5. The method of claim 1, wherein the synthetic feedstock comprises from about 20 wt. % to about 85 wt. % of an oil ($C_5$-$C_{15}$) and about 15 wt. % to about 95 wt. % of a wax ($\geq C_{16}$).

6. The method of claim 5, wherein the wax comprises a compound having from about 16 carbon atoms to about 36 carbon atoms.

7. The method of claim 1, wherein the synthetic feedstock comprises from about 35 wt. % to about 80 wt. % of an oil ($C_5$-$C_{15}$) and about 20 wt. % to about 65 wt. % of a wax ($>C_{16}$).

8. The method of claim 1, further comprising adding from about 50 ppm to about 5,000 ppm of the pour point depressant to the synthetic feedstock.

9. The method of claim 1, wherein the ethylene vinyl acetate copolymer has a weight average molecular weight ranging from about 900 g/mol to about 12,000 g/mol and a vinyl acetate content ranging from about 10 mol % to about 50 mol %.

10. The method of claim 1, wherein the alpha olefin maleic anhydride polymer has a weight average molecular weight ranging from about 20,000 g/mol to about 70,000 g/mol.

11. The method of claim 1, wherein the pour point depressant lowers the pour point of the synthetic feedstock by about 3° C. to about 42° C.

12. The method of claim 1, wherein the synthetic feedstock comprising the pour point depressant has a pour point less than about −5° C.

* * * * *